US008276674B2

(12) United States Patent
Lopez de Cardenas et al.

(10) Patent No.: US 8,276,674 B2
(45) Date of Patent: Oct. 2, 2012

(54) DEPLOYING AN UNTETHERED OBJECT IN A PASSAGEWAY OF A WELL

(75) Inventors: Jorge Lopez de Cardenas, Sugar Land, TX (US); Gary L. Rytlewski, League City, TX (US); Matthew R. Hackworth, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/945,186

(22) Filed: Nov. 12, 2010

(65) Prior Publication Data

US 2011/0056692 A1 Mar. 10, 2011

Related U.S. Application Data

(60) Continuation of application No. 11/834,869, filed on Aug. 7, 2007, now abandoned, which is a division of application No. 10/905,073, filed on Dec. 14, 2004, now Pat. No. 7,387,165.

(51) Int. Cl.
*E21B 34/14* (2006.01)

(52) U.S. Cl. ..... 166/373; 166/386; 166/318; 166/334.4

(58) Field of Classification Search ..... 166/373, 166/313, 386, 318, 332.4, 387
See application file for complete search history.

(56) References Cited

U.S. PATENT DOCUMENTS 2,223,442 A 12/1940 Crowell
2,316,643 A 4/1943 Yule
2,374,169 A 4/1945 Boyton
2,429,912 A 10/1947 Baker
2,458,278 A 1/1949 Larkin
2,962,097 A 11/1960 Dollison
3,011,548 A 12/1961 Holt
3,051,243 A 8/1962 Grimmer et al.
3,054,415 A 9/1962 Baker et al.
3,263,752 A * 8/1966 Conrad ..... 166/154
3,269,463 A 8/1966 Page, Jr.
3,270,814 A 9/1966 Richardson et al.
3,285,353 A 11/1966 Young
3,333,635 A 8/1967 Crawford (Continued)

FOREIGN PATENT DOCUMENTS

CA 2529962 C 7/2009

(Continued)

OTHER PUBLICATIONS

Thomson, D.W. and Nazroo, M.F., "Design and Installation of a Cost-Effective Completion System for Horizontal Chalk Wells Where Multiple Zones Require Acid Stimulation," Offshore Technology Conference, May 1997, Houston, Texas, SPE 51177 (a revision of SPE 39150).

(Continued)

*Primary Examiner* — David Andrews
(74) *Attorney, Agent, or Firm* — Rodney Warfford; Tim Curington; Fred Pruner

(57) ABSTRACT

A system includes a string that includes a passageway and a plurality of tools. The system further includes an untethered object that is adapted to be deployed in the passageway such that the object travels downhole via the passageway and controllably expand its size as the object travels downhole to selectively cause one of the tools to capture the object.

24 Claims, 14 Drawing Sheets

U.S. PATENT DOCUMENTS 3,395,758 A 8/1968 Kelly et al.
3,542,127 A 11/1970 Malone
3,741,300 A 6/1973 Wolff et al.
3,768,556 A 10/1973 Baker
3,789,926 A 2/1974 Henley et al.
3,995,692 A 12/1976 Seitz
4,064,937 A 12/1977 Barrington
4,099,563 A 7/1978 Hutchison et al.
4,176,717 A 12/1979 Hix
4,194,561 A 3/1980 Stokley et al.
4,246,968 A 1/1981 Jessup et al.
4,355,686 A 10/1982 Arendt et al.
4,429,747 A 2/1984 Williamson, Jr.
4,444,266 A 4/1984 Pringle
4,520,870 A 6/1985 Pringle
4,709,760 A 12/1987 Crist et al.
4,729,432 A 3/1988 Helms
4,771,831 A 9/1988 Pringle
4,813,481 A 3/1989 Sproul et al.
4,880,059 A 11/1989 Brandell et al.
4,949,788 A 8/1990 Szarka et al.
4,967,841 A 11/1990 Murray
4,991,654 A 2/1991 Brandell et al.
4,994,654 A 2/1991 St. Louis
5,029,644 A 7/1991 Szarka et al.
5,048,611 A 9/1991 Cochran
5,183,114 A 2/1993 Marshaw et al.
5,203,412 A 4/1993 Doggett
5,224,044 A 6/1993 Tamura
5,224,556 A 7/1993 Wilson et al.
5,242,022 A 9/1993 Burton et al.
5,295,393 A 3/1994 Thiercelin
5,333,692 A 8/1994 Baugh et al.
5,337,808 A 8/1994 Graham
5,361,856 A 11/1994 Surjaatmadja et al.
5,368,098 A 11/1994 Blizzard, Jr. et al.
5,375,661 A 12/1994 Daneshy et al.
5,381,862 A 1/1995 Szarka et al.
5,394,941 A 3/1995 Venditto et al.
5,413,173 A 5/1995 Mills et al.
5,513,703 A 5/1996 Mills et al.
5,526,888 A 6/1996 Gazewood
5,579,844 A 12/1996 Rebardi et al.
5,598,890 A 2/1997 Richard et al.
5,609,204 A 3/1997 Rebardi et al.
5,660,232 A 8/1997 Reinhardt
5,765,642 A 6/1998 Surjaatmadja
5,848,646 A 12/1998 Huber et al.
5,887,657 A 3/1999 Bussear et al.
5,921,318 A 7/1999 Ross
5,988,285 A 11/1999 Tucker et al.
6,006,838 A 12/1999 Whiteley et al.
6,009,947 A 1/2000 Wilson et al.
6,059,032 A 5/2000 Jones
6,155,342 A 12/2000 Oneal
6,186,230 B1 2/2001 Nierode
6,206,095 B1 3/2001 Baugh
6,216,785 B1 4/2001 Achee, Jr. et al.
6,220,357 B1 4/2001 Carmichael et al.
6,253,861 B1 7/2001 Carmichael et al.
6,286,599 B1 9/2001 Surjaatmadja et al.
6,302,199 B1 10/2001 Hawkins et al.
6,333,699 B1 12/2001 Zierolf
6,334,486 B1 1/2002 Carmody
6,371,208 B1 4/2002 Norman et al.
6,386,288 B1 5/2002 Snider et al.
6,394,184 B2 5/2002 Tolman et al.
6,443,228 B1 * 9/2002 Aronstam et al. ..... 166/250.11
6,464,006 B2 10/2002 Womble
6,513,595 B1 2/2003 Freiheit et al.
6,520,255 B2 2/2003 Tolman et al.
6,536,524 B1 3/2003 Snider
6,543,538 B2 4/2003 Tolman et al.
6,575,247 B2 6/2003 Tolman et al.
6,634,429 B2 10/2003 Henderson et al.
6,644,412 B2 11/2003 Bode et al.
6,662,874 B2 12/2003 Surjaatmadja et al.
6,672,405 B2 1/2004 Tolman et al.
6,675,891 B2 1/2004 Hailey, Jr. et al.
6,719,051 B2 4/2004 Hailey, Jr. et al.
6,719,054 B2 4/2004 Cheng et al.
6,725,933 B2 4/2004 Middaugh et al.
6,759,968 B2 7/2004 Zierolf
6,761,219 B2 7/2004 Snider et al.
6,880,638 B2 4/2005 Haughom et al.
6,907,936 B2 6/2005 Fehr et al.
6,951,331 B2 10/2005 Haughom et al.
6,994,170 B2 2/2006 Echols
6,997,263 B2 2/2006 Campbell et al.
7,021,384 B2 4/2006 Themig
7,066,264 B2 6/2006 Bissonnette et al.
7,066,265 B2 6/2006 Surjaatmadja
7,093,664 B2 8/2006 Todd et al.
7,096,945 B2 8/2006 Richards et al.
7,108,067 B2 9/2006 Themig et al.
7,128,152 B2 10/2006 Anyan et al.
7,128,160 B2 10/2006 Anyan et al.
7,134,505 B2 11/2006 Fehr et al.
7,168,494 B2 1/2007 Starr et al.
7,191,833 B2 3/2007 Richards
7,210,533 B2 5/2007 Starr et al.
7,322,417 B2 1/2008 Rytlewski et al.
7,325,616 B2 2/2008 Lopez de Cardenas et al.
7,325,617 B2 2/2008 Murray
7,353,879 B2 4/2008 Todd et al.
7,377,321 B2 5/2008 Rytlewski
7,387,165 B2 6/2008 Lopez de Cardenas et al.
7,431,091 B2 10/2008 Themig et al.
7,464,764 B2 12/2008 Xu
7,490,669 B2 2/2009 Walker et al.
7,543,634 B2 6/2009 Fehr et al.
7,543,647 B2 6/2009 Walker
7,552,779 B2 6/2009 Murray
7,571,765 B2 8/2009 Themig
7,575,062 B2 8/2009 East, Jr.
7,661,481 B2 2/2010 Todd et al.
7,748,460 B2 7/2010 Themig et al.
7,832,472 B2 11/2010 Themig
7,891,774 B2 2/2011 Silverbrook
2002/0007949 A1 1/2002 Tolman et al.
2002/0049575 A1 4/2002 Jalali et al.
2002/0093431 A1 7/2002 Zierolf
2002/0157837 A1 10/2002 Bode et al.
2002/0158120 A1 10/2002 Zierolf
2002/0166665 A1 11/2002 Vincent et al.
2003/0019634 A1 1/2003 Henderson et al.
2003/0070809 A1 4/2003 Schultz et al.
2003/0070811 A1 4/2003 Robison et al.
2003/0090390 A1 5/2003 Snider et al.
2003/0111224 A1 6/2003 Hailey, Jr. et al.
2003/0127227 A1 7/2003 Fehr et al.
2003/0136562 A1 7/2003 Robison et al.
2003/0180094 A1 9/2003 Madison
2003/0188871 A1 10/2003 Dusterhoft et al.
2003/0234104 A1 12/2003 Johnston et al.
2004/0020652 A1 2/2004 Campbell et al.
2004/0040707 A1 3/2004 Dusterhoft et al.
2004/0050551 A1 3/2004 Jones
2004/0055749 A1 3/2004 Lonnes et al.
2004/0084189 A1 5/2004 Hosie et al.
2004/0092404 A1 5/2004 Murray et al.
2004/0118564 A1 6/2004 Themig et al.
2004/0129422 A1 7/2004 Themig
2004/0231840 A1 11/2004 Ratanasirigulchai et al.
2004/0238168 A1 12/2004 Echols
2004/0262016 A1 12/2004 Farquhar
2005/0178552 A1 8/2005 Fehr et al.
2005/0230118 A1 10/2005 Noske et al.
2006/0076133 A1 4/2006 Penno
2006/0086497 A1 4/2006 Ohmer et al.
2006/0090893 A1 5/2006 Sheffield
2006/0090906 A1 5/2006 Themig
2006/0108110 A1 5/2006 McKeen
2006/0124310 A1 6/2006 Lopez de Cardenas et al.
2006/0124311 A1 6/2006 Lopez de Cardenas et al.
2006/0124312 A1 6/2006 Rytlewski et al.
2006/0124315 A1 6/2006 Frazier et al.

| | | | |
|---|---|---|---|
| 2006/0144590 | A1 | 7/2006 | Lopez de Cardenas et al. |
| 2006/0157255 | A1 | 7/2006 | Smith |
| 2006/0207763 | A1 | 9/2006 | Hofman |
| 2006/0207764 | A1 | 9/2006 | Rytlewski |
| 2006/0207765 | A1 | 9/2006 | Hofman |
| 2006/0243455 | A1 | 11/2006 | Telfer et al. |
| 2007/0007007 | A1 | 1/2007 | Themig et al. |
| 2007/0044958 | A1 | 3/2007 | Rytlewski et al. |
| 2007/0084605 | A1 | 4/2007 | Walker et al. |
| 2007/0107908 | A1 | 5/2007 | Vaidya et al. |
| 2007/0151734 | A1 | 7/2007 | Fehr et al. |
| 2007/0181224 | A1 | 8/2007 | Marya et al. |
| 2007/0272411 | A1 | 11/2007 | Lopez De Cardenas et al. |
| 2007/0272413 | A1 | 11/2007 | Rytlewski |
| 2007/0284097 | A1 | 12/2007 | Swor et al. |
| 2008/0000697 | A1 | 1/2008 | Rytlewski |
| 2008/0105438 | A1 | 5/2008 | Jordan et al. |
| 2008/0210429 | A1 | 9/2008 | McMillin et al. |
| 2008/0217021 | A1 | 9/2008 | Lembcke et al. |
| 2009/0084553 | A1 | 4/2009 | Rytlewski et al. |
| 2010/0065276 | A1 | 3/2010 | Fehr et al. |
| 2010/0101803 | A1 | 4/2010 | Clayton et al. |
| 2010/0132954 | A1 | 6/2010 | Telfer |
| 2010/0209288 | A1 | 8/2010 | Marya |
| 2011/0127047 | A1 | 6/2011 | Themig et al. |
| 2011/0146866 | A1 | 6/2011 | Jafari Valilou |
| 2011/0278010 | A1 | 11/2011 | Fehr et al. |
| 2012/0085538 | A1 | 4/2012 | Guerrero et al. |

FOREIGN PATENT DOCUMENTS

| | | | |
|---|---|---|---|
| DE | 102005060008 | A1 | 6/2006 |
| GB | 2375558 | A | 11/2002 |
| GB | 2386624 | A | 9/2003 |
| GB | 2411189 | A | 8/2005 |
| GB | 2424233 | A | 9/2006 |
| GC | 0001546 | | 10/2011 |
| MX | 2009002897 | A | 9/2009 |
| WO | 03/095794 | | 11/2003 |
| WO | 2004/088091 | | 10/2004 |

OTHER PUBLICATIONS

Lonnes, S. B., Nygaard, K. J., Sorem, W. A., Hall, T. J., Tolman, R. C., Advanced Multizone Stimulation Technology, SPE 95778, Presented at the 2005 SPE Annual Technical Conference and Exhibition, Oct. 9-12, 2005, Dallas, TX, USA.

Rytlewski, G., Multiple-Layer Commpletions for Efficient Treatment of Multilayer Reservoirs, IADC/SPE 112476, Presented at the 2008 IADC/SPE Drilling Conference, Mar. 4-6, 2008, Orlando, FL, USA.

McDaniel, B. W. Review of Current Fracture Stimulation Techniques for Best Economics in Multilayer, Lower-Permeability Reservoirs, SPE 98025, Presented at SPE Regional Meeting Sep. 14-16, 2005, Morgantown, WV, USA.

International Search Report of PCT Application No. PCT/US2011/037387 dated Feb. 9, 2012.

* cited by examiner

DEPLOYING AN UNTETHERED OBJECT IN A PASSAGEWAY OF A WELL

This application is a continuation of U.S. patent application Ser. No. 11/834,869, entitled, "SYSTEM FOR COMPLETING MULTIPLE WELL INTERVALS," which was filed on Aug. 7, 2007 (abandoned), which is a divisional of Ser. No. 10/905,073, filed Dec. 14, 2004, U.S. Pat. No. 7,387,165, entitled, "SYSTEM FOR COMPLETING MULTIPLE WELL INTERVALS," which issued on Jun. 17, 2008. The Ser. No. 11/834,869 application and the U.S. Pat. No. 7,387,165 are each hereby incorporated by reference in its entirety.

BACKGROUND

The present invention relates generally to recovery of hydrocarbons in subterranean formations, and more particularly to a system and method for delivering treatment fluids to wells having multiple production zones.

In typical wellbore operations, various treatment fluids may be pumped into the well and eventually into the formation to restore or enhance the productivity of the well. For example, a non-reactive "fracturing fluid" or a "frac fluid" may be pumped into the wellbore to initiate and propagate fractures in the formation thus providing flow channels to facilitate movement of the hydrocarbons to the wellbore so that the hydrocarbons may be pumped from the well. In such fracturing operations, the fracturing fluid is hydraulically injected into a wellbore penetrating the subterranean formation and is forced against the formation strata by pressure. The formation strata is forced to crack and fracture, and a proppant is placed in the fracture by movement of a viscous-fluid containing proppant into the crack in the rock. The resulting fracture, with proppant in place, provides improved flow of the recoverable fluid (i.e., oil, gas or water) into the wellbore. In another example, a reactive stimulation fluid or "acid" may be injected into the formation. Acidizing treatment of the formation results in dissolving materials in the pore spaces of the formation to enhance production flow.

Currently, in wells with multiple production zones, it may be necessary to treat various formations in a multi-staged operation requiring many trips downhole. Each trip generally consists of isolating a single production zone and then delivering the treatment fluid to the isolated zone. Since several trips downhole are required to isolate and treat each zone, the complete operation may be very time consuming and expensive.

Accordingly, there exists a need for systems and methods to deliver treatment fluids to multiple zones of a well in a single trip downhole.

SUMMARY

In an embodiment of the invention, a technique includes providing a string that includes a passageway and a plurality of tools. The technique includes deploying an untethered object in the passageway such that the object travels downhole via the passageway; and expanding a size of the object as the object travels downhole to selectively cause one of the tools to capture the object.

In another embodiment of the invention, a system includes a string that comprising a passageway and a plurality of tools. The system further includes an untethered object that is adapted to be deployed in the passageway such that the object travels downhole via the passageway and controllably expand its size as the object travels downhole to selectively cause one of the tools to capture the object.

In yet another embodiment of the invention, a system includes a string; a plurality of valves disposed in the string; and a dart. Each of the valves includes a seat, and each of the seats is sized to catch an object that has substantially the same size traveling through the passageway of the string. Each of the valves is adapted to control fluid communication between the passageway of the string and a region that is exterior to the string. The dart is adapted to be deployed in the passageway such that the dart travels downhole via the passageway and controllably expands its size as the dart travels downhole to selectively cause the dart to lodge in one of the seats.

Advantages and other features of the invention will become apparent from the following drawing, description and claims.

BRIEF DESCRIPTION OF THE DRAWING

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and "downwardly", "upstream" and "downstream"; "above" and "below"; and other like terms indicating relative positions above or below a given point or element are used in this description to more clearly describe some embodiments of the invention. Moreover, the term "sealing mechanism" includes: packers, bridge plugs, downhole valves, sliding sleeves, baffle-plug combinations, polished bore receptacle (PBR) seals, and all other methods and devices for temporarily blocking the flow of fluids through the wellbore. Furthermore, the term "treatment fluid" includes any fluid delivered to a formation to stimulate production including, but not limited to, fracing fluid, acid, gel, foam or other stimulating fluid.

Generally, this invention relates to a system and method for completing multi-zone wells by delivering a treatment fluid to achieve productivity. Typically, such wells are completed in stages that result in very long completion times (e.g., on the order of four to six weeks). The present invention may reduce such completion time (e.g., to a few days) by facilitating multiple operations, previously done one trip at a time, in a single trip.

Figure 1:
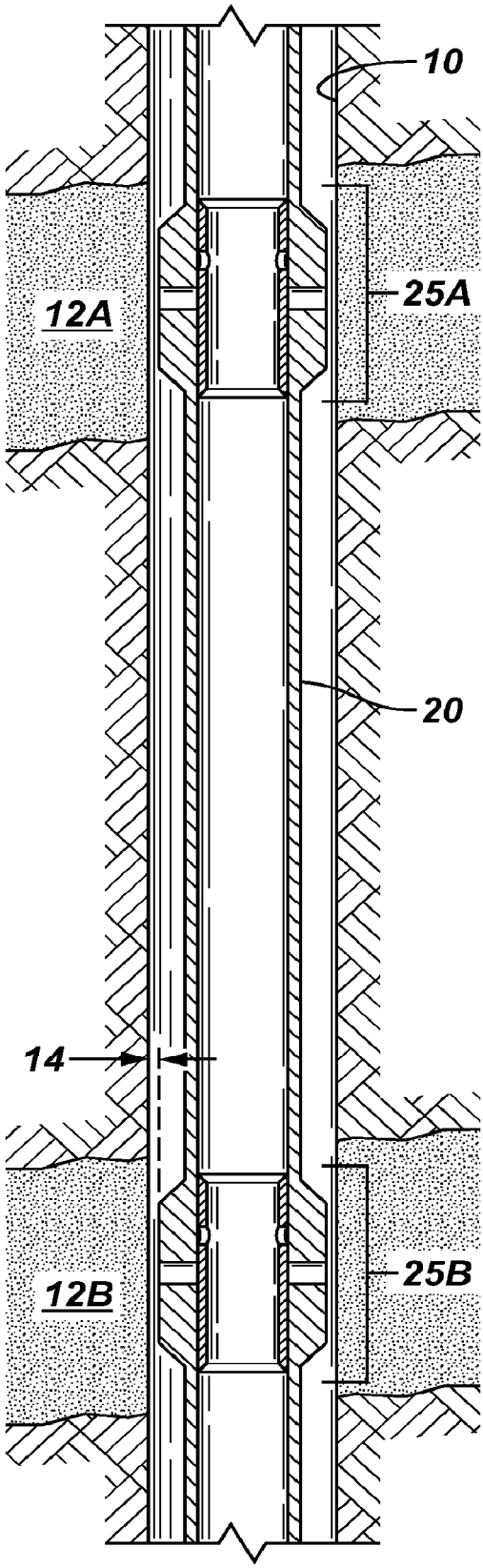
FIG. 1 illustrates a profile view of an embodiment of the multi-zonal well completion system of the present invention having zonal communication valves being installed/deployed in a wellbore.

FIG. 1 illustrates an embodiment of the well completion system of the present invention for use in a wellbore 10. The wellbore 10 may include a plurality of well zones (e.g., formation, production, injection, hydrocarbon, oil, gas, or water zones or intervals) 12A, 12B. The completion system includes a casing 20 having one or more zonal communication valves 25A, 25B arranged to correspond with each formation zone 12A, 12B. The zonal communication valves 25A, 25B function to regulate hydraulic communication between the axial bore of the casing 20 and the respective formation zone 12A, 12B. For example, to deliver a treatment fluid to formation zone 12B, valve 25B is opened and valve 25A is closed. Therefore, any treatment fluid delivered into the casing 20 from the surface will be delivered to zone 12B and bypass zone 12A. The valves 25A, 25B of the well completion system may include any type of valve or various combinations of valves including, but not limited to, sliding or rotating sleeve valves, ball valves, flapper valves and other valves. Furthermore, while this embodiment describes a completion system including a casing, in other embodiments any tubular string may be used including a casing, a liner, a tube, a pipe, or other tubular member.

Regarding use of the well completion system of the present invention, some embodiments may be deployed in a wellbore (e.g., an open or uncased hole) as a temporary completion. In such embodiments, sealing mechanisms may be employed between each valve and within the annulus defined by the tubular string and the wellbore to isolate the formation zones being treated with a treatment fluid. However, in other embodiments the valves and casing of the completion system may be cemented in place as a permanent completion. In such embodiments, the cement serves to isolate each formation zone.

Figure 2A:
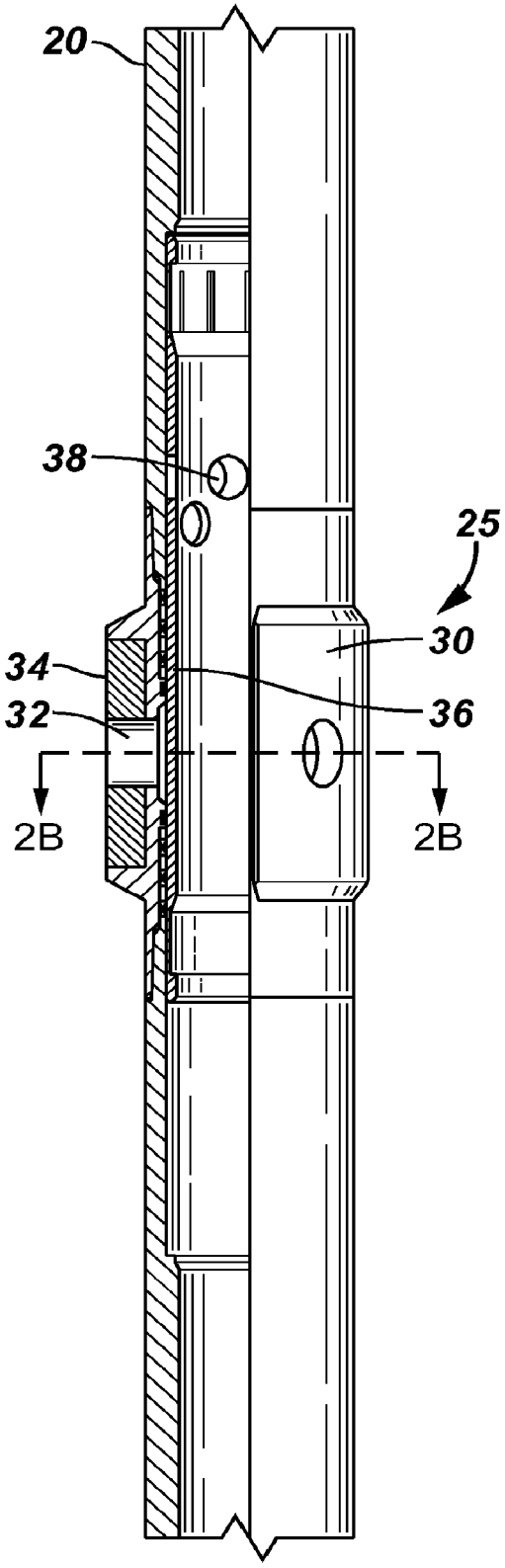
FIGS. 2A-2B illustrate profile and cross-sectional views of an embodiment of a sliding sleeve zonal communication valve of the present invention.
Figure 2B:
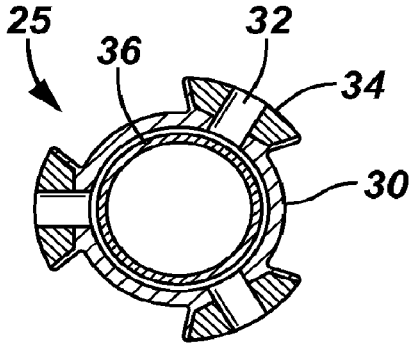

FIGS. 2A and 2B illustrate an embodiment of a zonal communication valve 25. The valve 25 includes an outer housing 30 having an axial bore therethrough and which is connected to or integrally formed with a casing 20 (or other tubular string). The housing 30 has a set of housing ports 32 formed therein for establishing communication between the wellbore and the axial bore of the housing. In some embodiments, the housing 30 also includes a set of "lobes" or protruding elements 34 through which the ports 32 are formed. Each lobe 34 protrudes radially outward to minimize the gap 14 between the valve 25 and wellbore 10 (as shown in FIG. 1), yet cement may still flow through the recesses between the lobes during cementing-in of the casing. By minimizing the gap 14 between the lobes 34 and the formation, the amount of cement interfering with communication via the ports 32 is also minimized. A sleeve 36 is arranged within the axial bore of the housing 30. The sleeve 36 is moveable between: (1) an "open port position" whereby a flowpath is maintained between the wellbore and the axial bore of the housing 30 via the set of ports 32, and (2) a "closed port position" whereby the flowpath between the wellbore and the axial bore of the housing 30 via the set of ports 32 is obstructed by the sleeve 36. In some embodiments, the sleeve 36 includes a set of sleeve ports 38, which are aligned with the set of ports 32 of the housing 30 in the open port position and are not aligned with the set of ports 32 of the housing 30 in the closed port position. In other embodiments, the sleeve 36 does not include ports and the valve 25 is moved between the open port position and the closed port position by moving the sleeve 36 out of proximity of the set of ports 32 and moving the sleeve 36 to cover the set of ports 32, respectively. While in this embodiment, the sleeve 36 is moved between the open port position and closed port position by sliding or indexing axially, in other embodiments, the sleeve may be moved between the open port position and the closed port position by rotating the sleeve about the central axis of the housing 30. Furthermore, while this embodiment of the valve 25 includes a sleeve 36 arranged within the housing 30, in an alternative embodiment, the sleeve 36 may be located external of the housing 30.

Figure 3:
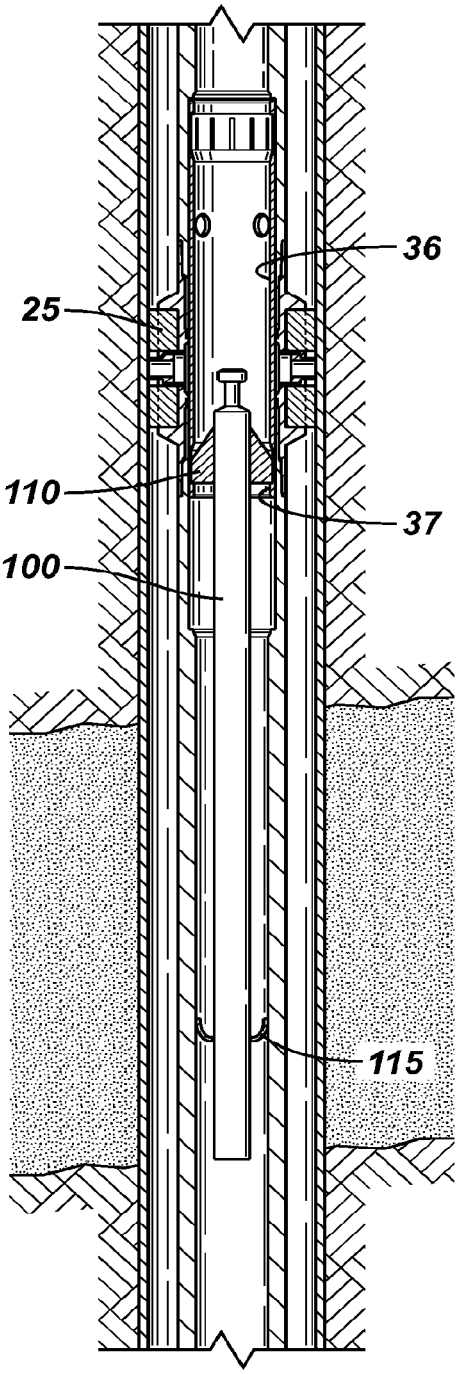
FIG. 3 illustrates a cross-sectional view of an embodiment of an actuating dart for use in actuating the sliding sleeve of the zonal communication valve.

Actuation of the zonal communication valve may be achieved by any number of mechanisms including, but not limited to, darts, tool strings, control lines, and drop balls. Moreover, embodiments of the present invention may include wireless actuation of the zonal communication valve as by pressure pulse, electromagnetic radiation waves, seismic waves, acoustic signals, and other wireless signaling. FIG. 3 illustrates one embodiment of an actuation mechanism for selectively actuating the valves of the well completion system of the present invention. A dart 100 having a latching mechanism 110 (e.g., a collet) may be released into the casing string 20 and pumped downhole to engage a mating profile 37 formed in the sliding sleeve 36 of a valve 25. Once engaging the sleeve, hydraulic pressure behind the dart 100 may be increased to a predetermined level to shift the sleeve between the open port position and the closed port position. Certain embodiments of the dart 100 may include a centralizer 115 (e.g., guiding fins).

Figure 4A:
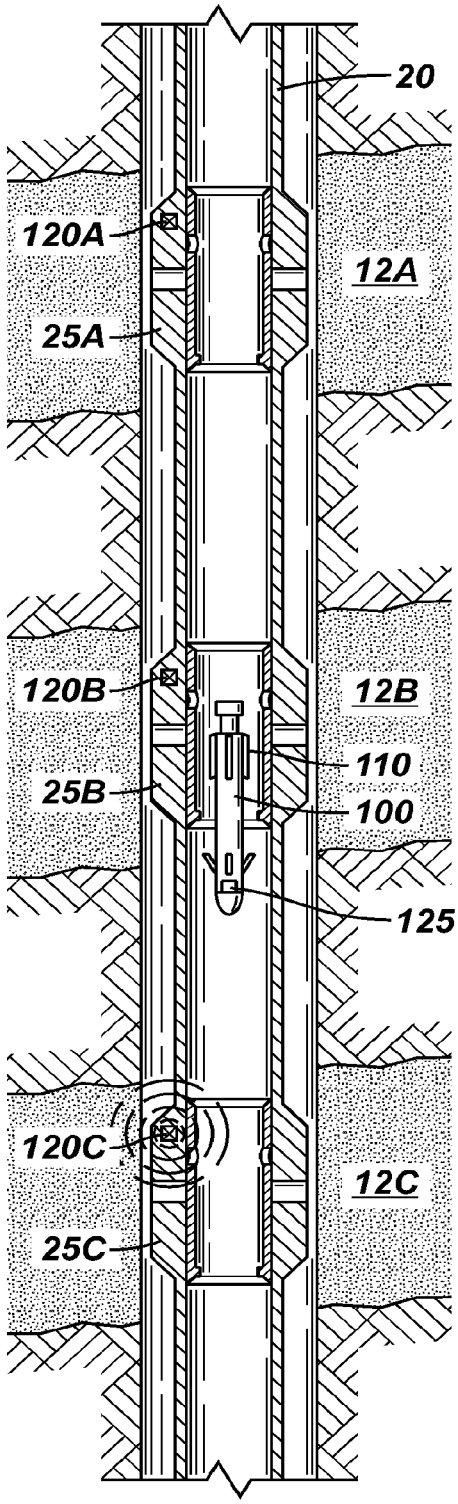
FIGS. 4A-4E illustrates a cross-sectional view of an embodiment of the sliding sleeve zonal communication valve being actuated by a dart using RF receivers/emitters.
Figure 4B:
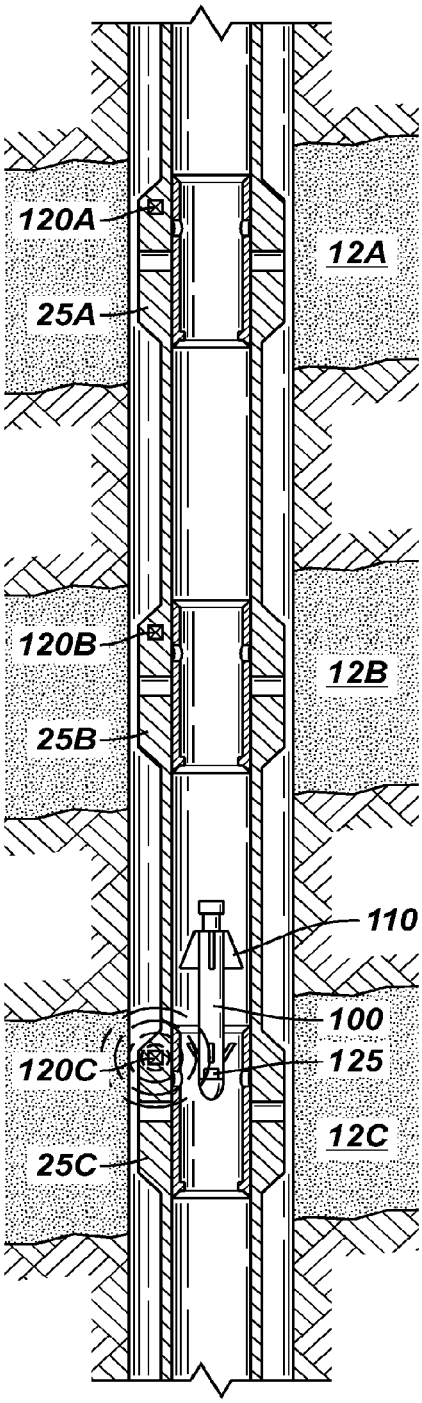
Figure 4C:
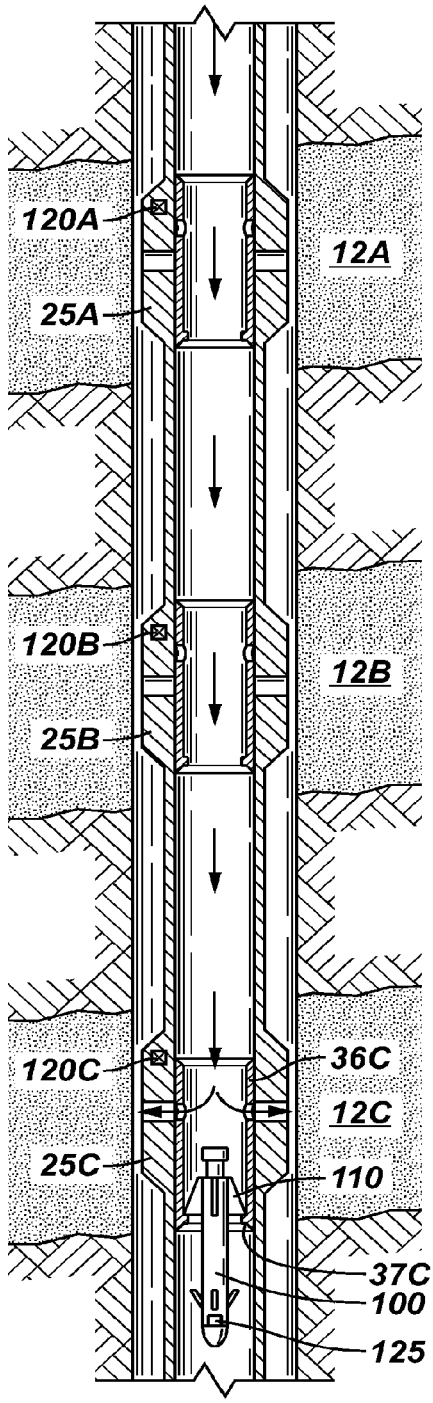

In some embodiments of the dart of the present invention, the latching mechanism 110 is static in that the latching mechanism is biased radially outward to engage the mating profile 37 of the sleeve 36 of the first valve 25 encountered (see FIG. 3). In other embodiments, the latching mechanism 110 is dynamic in that the dart 100 is initially run downhole with the latching mechanism collapsed (as shown in FIG. 4A) and is programmed to bias radially outward upon coming into proximity of a predetermined valve (see FIG. 4B). In this way, the valve 25 of a particular formation interval may be selected for opening to communicate a treatment fluid to the underlying formation. For example, with respect to FIG. 4A, each valve 25A, 25B, 25C includes a transmitter device 120A, 120B, 120C for emitting a particular signal (e.g., a radio frequency "RF" signal, an acoustic signal, a radioactive signal, a magnetic signal, or other signal). Each transmitter 120A, 120B, 120C of each valve 25A, 25B, 25C may emit a unique RF signal. A dart 100 is pumped downhole from the surface having a collet 110 (or other latching mechanism) arranged in a collapsed (i.e., non-radially biased) position. The dart 100 includes a receiver 125 for receiving a particular target RF signal. As the dart 100 passes through valves 25A, 25B emitting a different RF signal, the collet 110 remains collapsed. With respect to FIG. 4B, as the dart 100 comes into proximity of the valve 25C emitting the target RF signal, the collet 110 springs radially outward into a biased position. With respect to FIG. 4C, the biased collet 110 of the dart 100 latches to the mating profile 37C valve of the sleeve 36C. The dart 100 and the sleeve 36C may then be pumped downward until the valve 36C is moved into the open port position whereby delivering a treatment fluid to the formation interval 12C may be achieved.

Figure 4D:
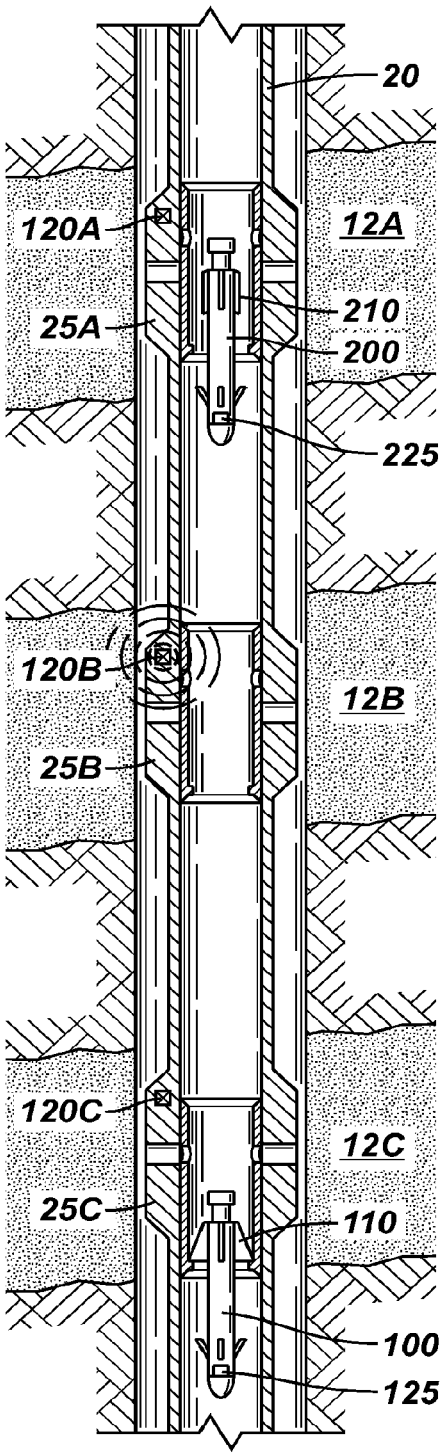
Figure 4E:
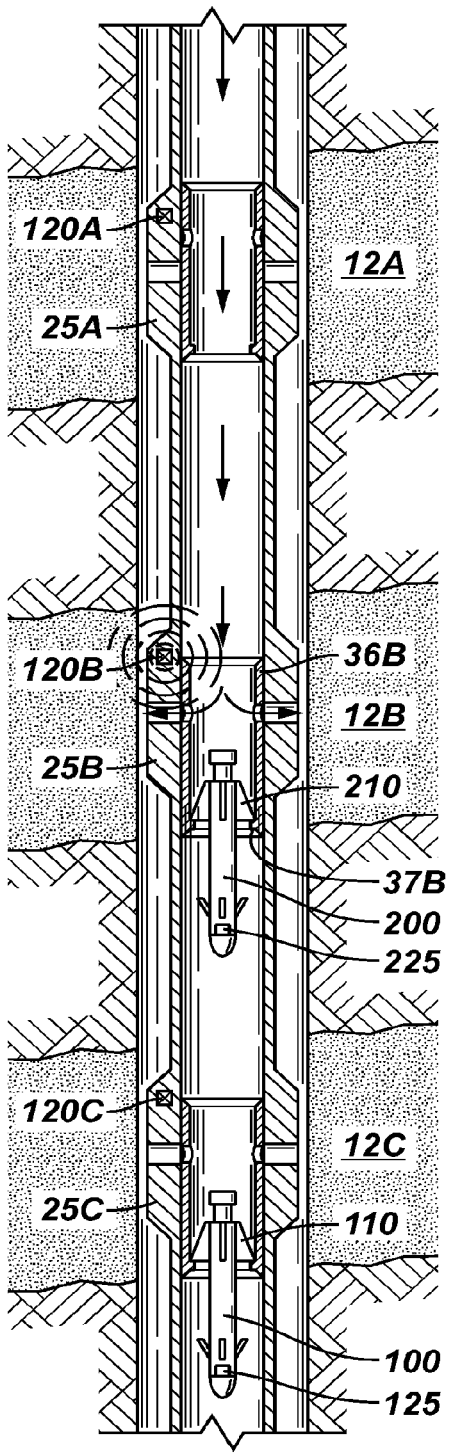

In some embodiments, the dart may include a sealing mechanism to prevent treatment fluid from passing below the dart once it is latched with the sliding sleeve of the valve. With respect to FIG. 4D, in these embodiments, another dart 200 may be released into the casing string 20 and pumped downhole. As with the previous dart 100, the collet 210 of dart 200 remains in a collapsed position until the dart 200 comes into proximity of the transmitter 120B of the valve 25B emitting the target RF signal corresponding to the receiver 225 of the dart 200. With respect to FIG. 4E, once the signal is received, the collet 210 springs radially outward into a biased position to latch and seal with the mating profile 37B of the valve sleeve 36B. The dart 200 and the sleeve 36B may then be pumped downward until the valve 25B is moved into the open port position and whereby valve 25B is isolated from valves 25A and 25C. In this way, a treatment fluid may be delivered to the formation interval 12B. In one embodiment of the present invention, the darts may include a fishing profile such that the darts may be retrieved after the treatment fluid is delivered and before the well is produced.

In another embodiment of the well completion system of the present invention, with reference to FIGS. 11A-11E, instead of pumping a latching mechanism downhole on a dart, a latching mechanism 700 (e.g., a collet) may be run downhole on a work string 705 (e.g., coiled tubing, slickline, drill pipe, or wireline). The latching mechanism 700 is used to engage the sleeve 36A, 36B, 36C to facilitate shifting the sleeve between the open port position and the closed port position. In well stimulation operations, the latching mechanism 700 may be used to open the corresponding valve 25A, 25B, 25C of the formation interval 12A, 12B, 12C targeted for receiving a treatment fluid. In this way, the target formation interval is isolated from any other formation intervals during the stimulation process. For example, in one embodiment, a latching tool 700 having a collet 710 may be run downhole on a slickline 705. The collet 710 includes a plurality of fingers 712 having protruding elements 714 formed on each end for engaging a mating profile 39A, 39B, 39C formed on the inner surface of the sliding sleeve 36A, 36B, 36C of each valve 25A, 25B, 25C. The collet 710 may be actuated between a first position whereby the fingers 712 are retracted (see FIG. 11A) and a second position whereby the fingers are moved to extend radially outward (see FIG. 11B). The collet 710 may be actuated by pressure pulses emitted from the surface for reception by a controller included in the latching tool 700. Alternatively, the latching tool 700 may also include a tension converter such that signals may be delivered to the controller of the latching tool by vertical motion in the slick line 705 (e.g., pulling on the slickline form the surface). In operation, the latching tool 700 is run to the bottom-most valve 25C with the collet 710 in the first retracted position. Once the latching tool 700 reaches the target depth proximate the formation interval 12C, the collect 710 is activated from the surface to extend the fingers 712 radially outward such that the elements 714 engage the mating profile 39C of the sliding sleeve 36C. The latching tool 700 is pulled axially upward on the slickline 705 to shift the sliding sleeve 36C from the closed port position to the open port position, thereby permitting delivery of a treatment fluid into the underlying formation interval 12C. After treating the formation interval 12C, the latching tool 700 is again pulled axially upward on the slickline 705 to shift the sliding sleeve 36C from the open port position to the closed port position. The collet 710 is then again actuated to retract the plurality of fingers 712 and disengage from the sliding sleeve 36C. The latching mechanism 100 may then be moved upward to the next valve 25B such that the valve may be opened, a treatment fluid may be delivered to the formation interval 12B, and then the valve may be closed again. This process may be repeated for each valve in the well completion system.

Figure 5A:
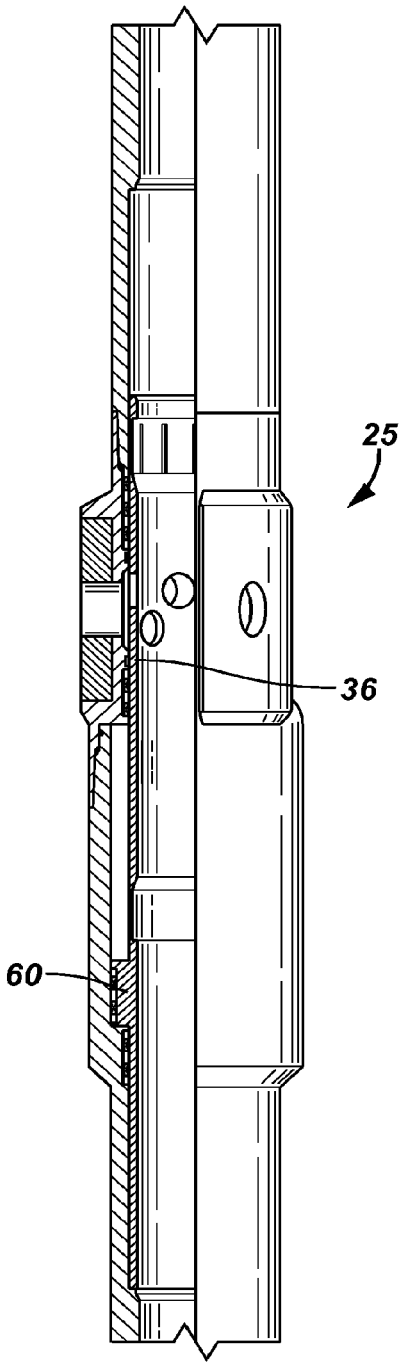
FIG. 5A illustrates a cross-sectional view of an embodiment of the zonal communication valve having an integral axial piston for actuating the sleeve.
Figure 5B:
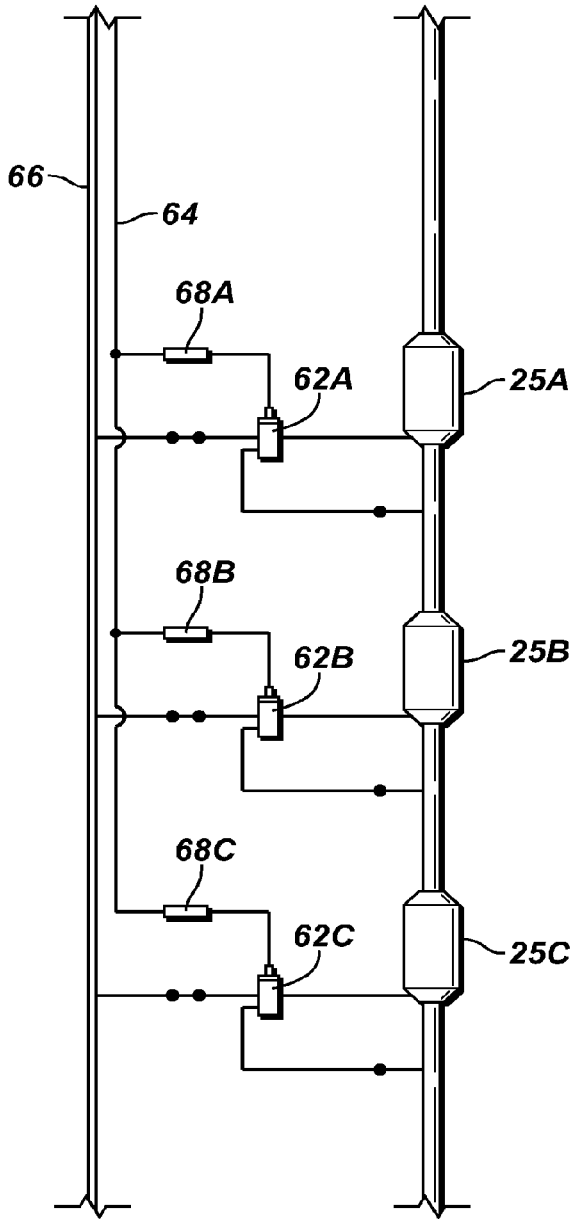
FIG. 5B illustrates a schematic view of an embodiment of the well completion system of the present invention having a control line network for actuating one or more zonal communication valves.

In yet other embodiments of the present invention, the valves of the well completion system may be actuated by a network of control lines (e.g., hydraulic, electrical, fiber optics, or combination). The network of control lines may connect each of the valves to a controller at the surface for controlling the position of the valve. With respect to FIGS. 5A-5B, each valve 25A, 25B, 25C includes an integral axial piston 60 for shifting the sleeve 36 between the open port position and the closed port position and a solenoid 62A, 62B, 62C for energizing the piston of each valve 25A, 25B, 25C. An embodiment of this network may include an individual control line for every valve 25 running to the surface, or may only be a single electric control line 64 and a hydraulic supply line 66. With regard to the embodiment including the single electric control line 64, a unique electrical signal is sent to an addressable switch 68A, 68B, 68C electrically connected to a solenoid 62A, 62B, 62C. Each addressable switch 68A, 68B, 68C recognizes a unique electric address and passes electric power to the respective solenoid 62A, 62B, 62C only when the unique signal is received. Each solenoid 62A, 62B, 62C ports hydraulic pressure from the supply line or vents hydraulic pressure to the formation, casing or back to surface. When activated each solenoid 62A, 62B, 62C moves the sleeve 36 between the open port position and the closed port position.

Figure 6:
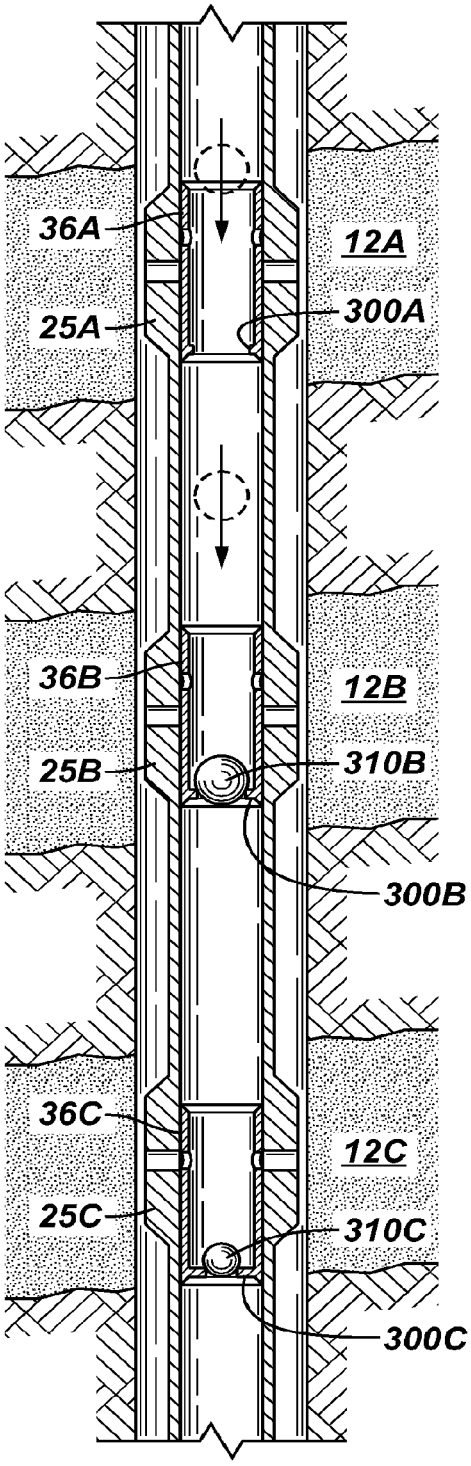
FIG. 6 illustrates a profile view of an embodiment of the multi-zonal well completion system of the present invention having zonal communication valves being actuated by one or more drop balls.

In still other embodiments of the well completion system of the present invention, the actuation mechanism for actuating the valves may include a set of drop balls. With respect to FIG. 6, the valves 25A, 25B, 25C may each include a drop ball seat 300A, 300B, 300C for landing a drop ball in the sleeve 36A, 36B, 36C and sealing the axial bore therethrough. Pressure can then be applied from the surface behind the drop ball to shift each sleeve 36A, 36B, 36C between the open port position and closed port position. In one embodiment, each valve may have a seat sized to catch a ball of a particular size. For example, the seat 300B of an upper valve 25B may have an axial bore therethrough having a diameter larger than the seat 300C of a lower valve 25C such that the drop ball 310C for actuating the lower valve 25C may pass through the axial bore of the seat 300B of the upper valve 25B. This permits opening of the lower valve 25C first, treating the formation 12C, then opening the upper valve 25B with drop ball 310B and treating the formation 12B. As with the darts, the balls may seal with the seats to isolate the lower valves during the delivery of a treatment fluid.

Figure 7:
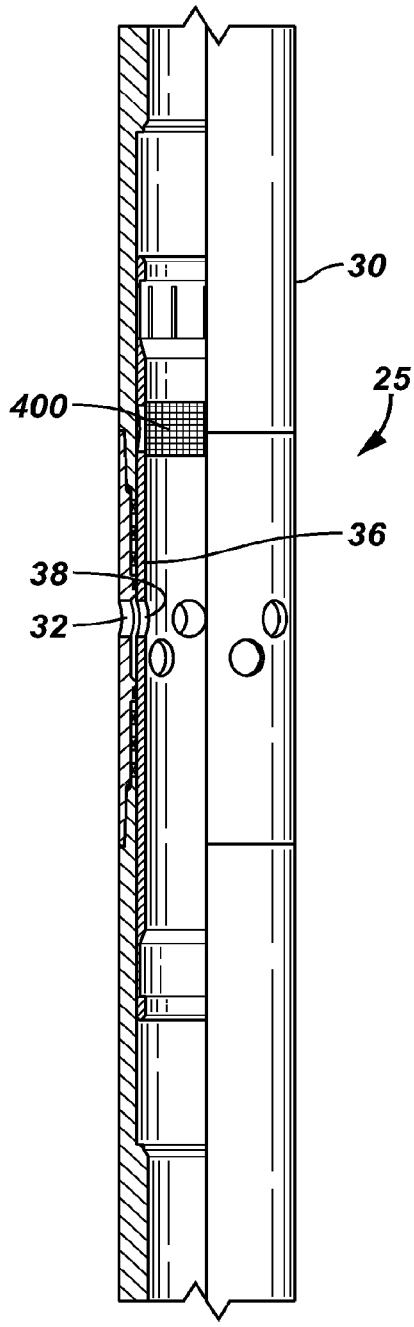
FIG. 7 illustrates a cross-sectional view of a sliding sleeve zonal communication valve having an additional filtering position.

FIG. 7 illustrates another embodiment of a zonal communication valve 25 for use with the well completion system of the present invention. As with the embodiment shown in FIG. 2, the valve 25 includes a housing 30 having a set of housing ports 32 formed therein and a sliding sleeve 36 having a set of corresponding sleeve ports 38 formed therein. However, in this embodiment, the sleeve 36 also includes a filter 400 formed therein. When aligned with the set of housing ports 32 of the housing 30, the filter 400 of the sleeve 36 provides a third position in which the valve 25 may operate. In well operations, an embodiment of the valve 25 includes three positions: (1) closed, (2) fully open to deliver a treatment fluid, and (3) open through a filter 400. The "filtering position" may be selected to prevent proppant or alternatively for traditional sand control (i.e., to prevent produced sand from flowing into the wellbore). The filter 400 may be fabricated as any conventional sand control screen including, but not limited to, slotted liner, wire wrapped, woven wire cloth, and sintered laminate sand control media.

Figure 8A:
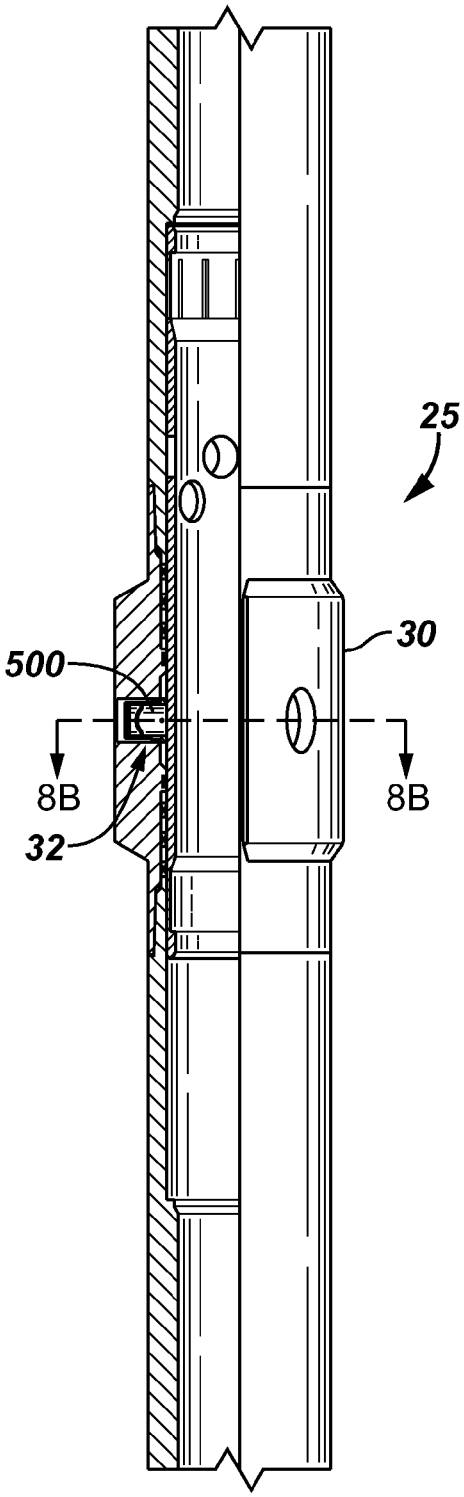
FIGS. 8A-8D illustrate cross-sectional views of various embodiments of pump-out piston ports of a zonal communication valve.
Figure 8B:
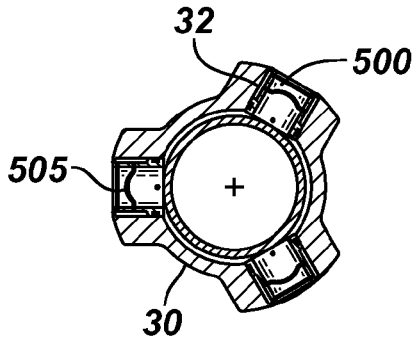
Figure 8C:
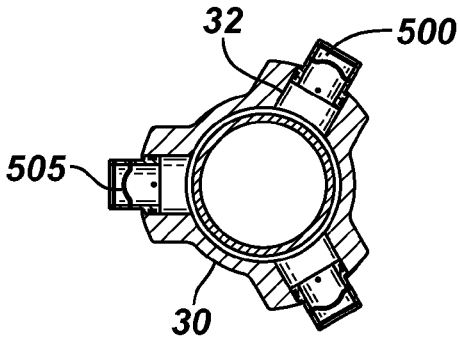
Figure 8D:
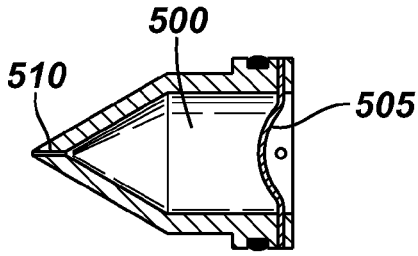

FIGS. 8A-8C illustrate yet another embodiment of the zonal communication valve 25 of for use with the cemented-in well completion system of the present invention. In this embodiment, each port 32 of the housing 30 includes an extendable piston 500 having an axial bore therethrough for defining a flowpath between the formation and the axial bore of the valve 25. Each piston 500 may be extended to engage the formation and seal against cement intrusion during the cementing-in of the casing, thereby permitting cement to flow past the extended pistons. Generally, each valve 25 is run downhole with the casing having the pistons 500 in a retracted position. Once the target depth of the casing is reached, the pistons 500 may be pressurized to extend radially outward and engage and/or seal against the formation. In some embodiments, each piston includes a frangible seal 505 (e.g., a rupture disc) arranged therein for preventing cement from flowing into the piston 500. Once the cement is cured, the valve 25 may be pressurized to break the seal 505 and establish hydraulic communication with the formation. Treatment fluid may then be delivered to the formation via the extended pistons 500. Alternatively, a thin metal flap may be attached the housing to cover the ports and block any flow of cement into valve. In this embodiment, the flap may be torn free from the housing by the pressure of the treatment fluid during stimulation of the underlying interval. In an alternative embodiment of the pistons 500, as shown in FIG. 5D, each piston 500 may be provided a sharp end 510 to provide an initiation point for delivering a treatment fluid once extended to engage the formation. These alternative pistons 500 may be open ended with a frangible seal 505 or have a closed end with no frangible seal (not shown). In the case of a closed end, the sharp, pointed end 510 of the piston 500 would break under pressure to allow hydraulic communication with the formation.

Figure 9A:
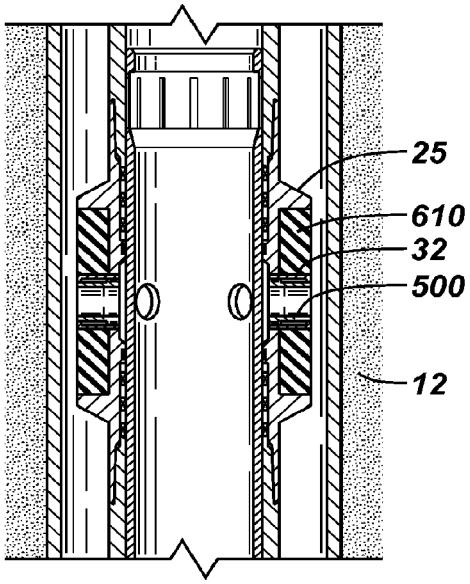
FIGS. 9A-9H illustrate cross-sectional views of an embodiment of a sliding sleeve zonal communication valve being installed in a wellbore.
Figure 9B:
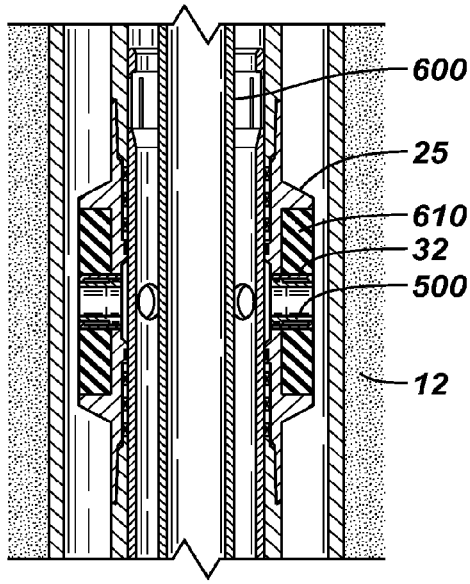
Figure 9C:
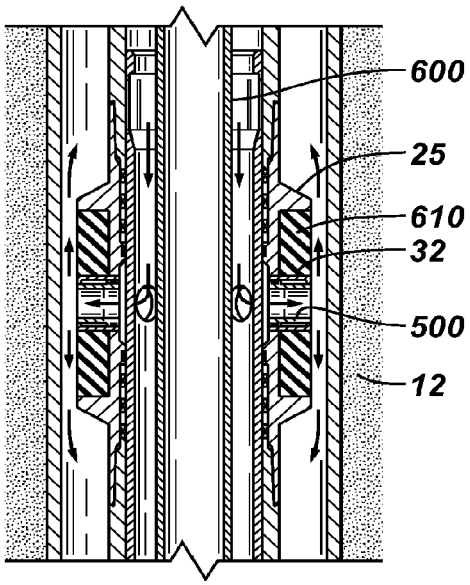
Figure 9D:
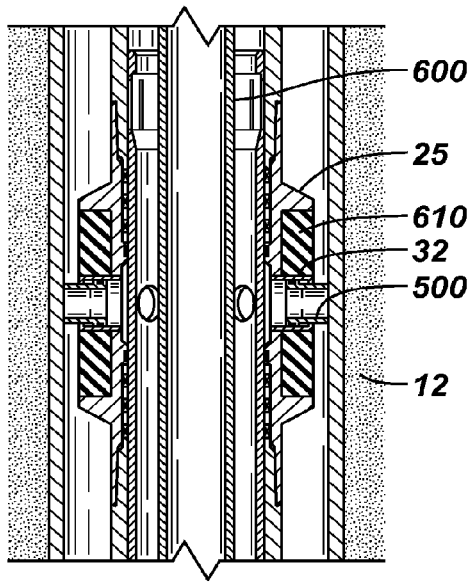
Figure 9E:
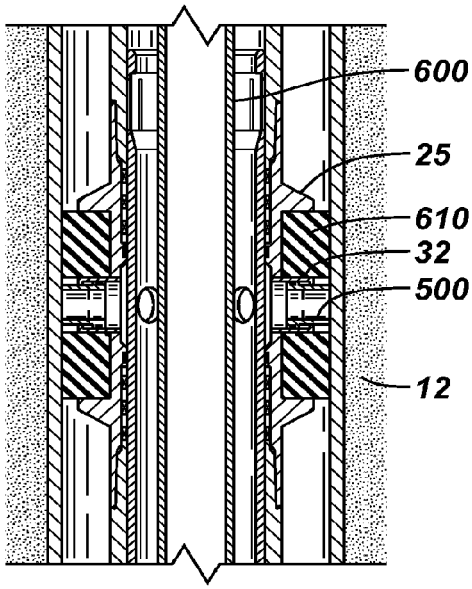
Figure 9F:
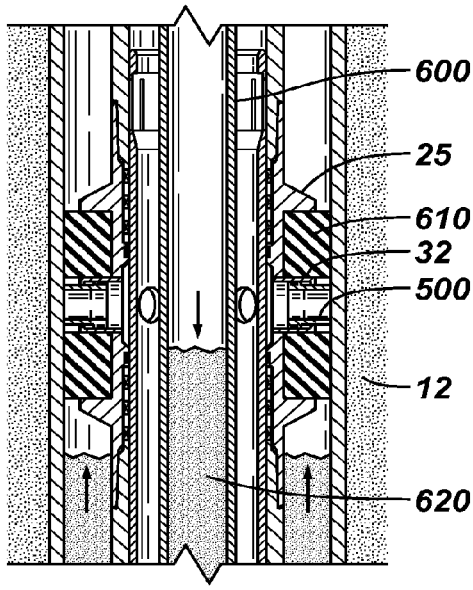
Figure 9G:
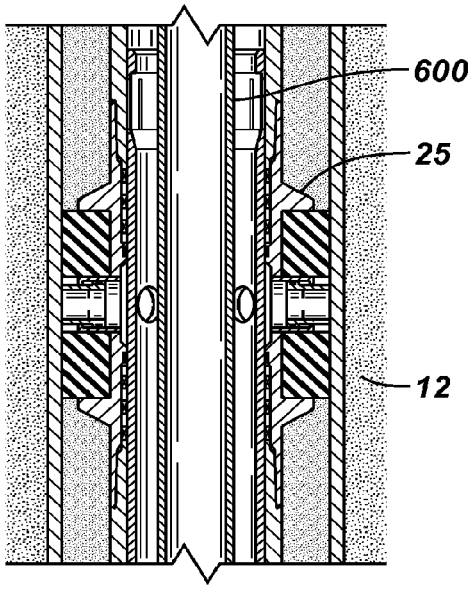
Figure 9H:
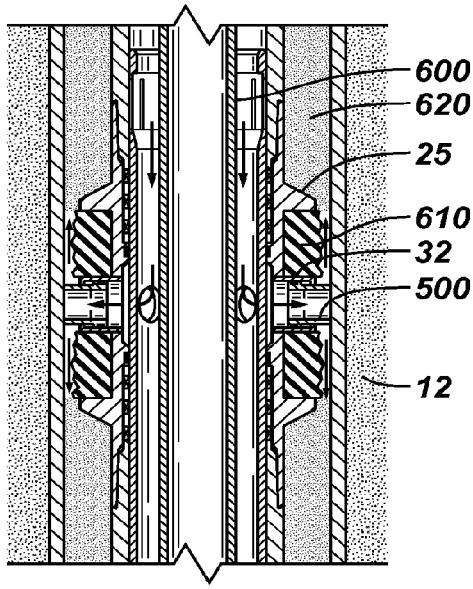

With respect to FIGS. 9A-9H, an embodiment of a procedure for installing the well completions system of the present invention is provided. In this embodiment, the well completion system is integral with a casing string and is cemented in the wellbore as a permanent completion. The cement provides zonal isolation making any mechanical zonal isolation device (external casing packers, swelling elastomer packers, and so forth) unnecessary. First, a casing string having one or more zonal communication valves 25 is run in a wellbore to a target depth where each valve is adjacent to a respective target formation zone 12 (FIG. 9A). A tubing string 600 is run through the axial bore of the casing to the bottom of the casing (FIG. 9B) and creates a seal between the casing and the tubing work string 600 (e.g., by stabbing into a seal bore). Hydraulic pressure is applied from the surface around the tubing string 600 to each valve 25 to actuate the set of pistons 500 in each port 32 and extend the pistons 500 radially outward to engage the target formation 12 (FIGS. 9C and 9D). In some embodiments, the hydraulic housing ports 32 may be packed with grease, wax, or some other immiscible fluid/substance to improve the chance of the tunnel staying open during the cementing operation. In alternative embodiments, the well completion system of the present invention is run downhole without a set of pistons 500 in the ports 32. Moreover, in some embodiments, an expandable element 610 is arranged around the set of ports may be formed of a swellable material (e.g., swellable elastomer blend, swellable rubber, or a swellable hydrogel). This swellable material may react with water, oil, and/or another liquid in the wellbore causing the material to expand outward to form a seal with the formation 12 (FIG. 9E). In some embodiments, the swellable material may be dissolvable after the cementing operation is complete. In alternative embodiments, a frangible material, permeable cement, or other device may be used to prevent cement from entering the valve 25 from the wellbore annulus side. These devices maybe used with the swellable material, which also helps keep cement from entering the valve or the devices may be used in combination with other devices, or alone. After the set of pistons 500 of each valve 25 are extended, cement 620 is pumped downward from the surface to the bottom of the casing via the tubing string 600 and upward into the annulus between the casing and the wellbore (FIGS. 9F and 9G). In one embodiment of the present invention, once cementing of the casing is complete, a liquid may be pumped into the casing to wash the cement away from the set of ports 500 (FIG. 9H). Alternatively, a retardant may be injected into the cement via the set of ports 500 such that the treatment fluid can flush the set of ports and engage the formation interval 12. Moreover, in some embodiments, the external surface of the valve housing 30 may be coated with a slippery or non-bonding material such as Teflon®, Xylan®, Kynar®, PTFE, FEP, PVDF, PFA, ECTFE, or other fluorpolymer coating materials.

Figure 10A:
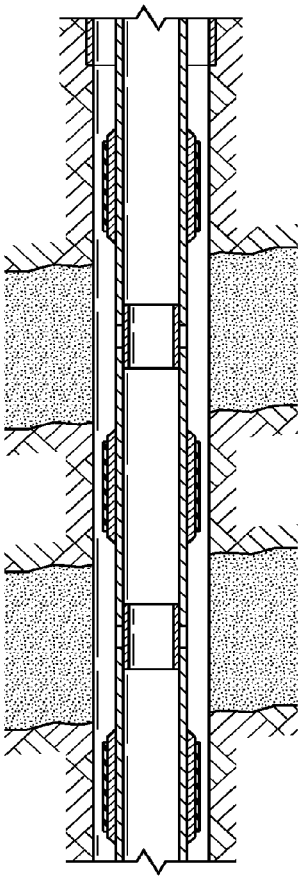
FIGS. 10A-10C illustrate profile views of an embodiment of the well completion system of the present invention being deployment in an open or uncased hole.
Figure 10B:
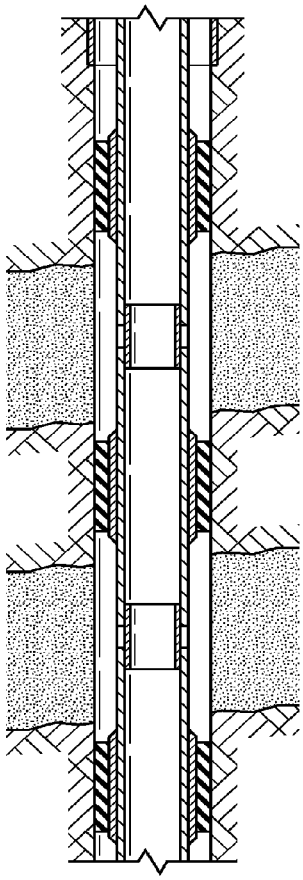
Figure 10C:
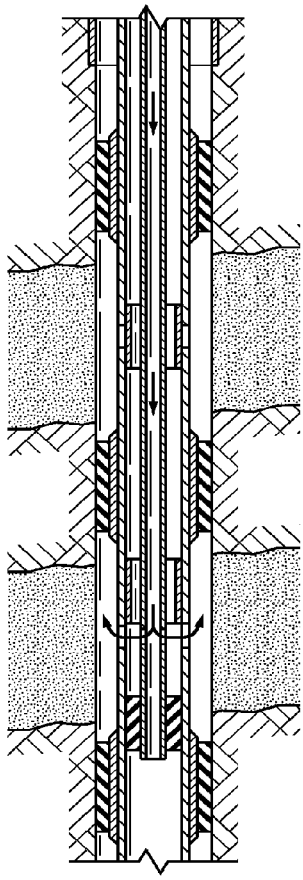
Figure 11A:
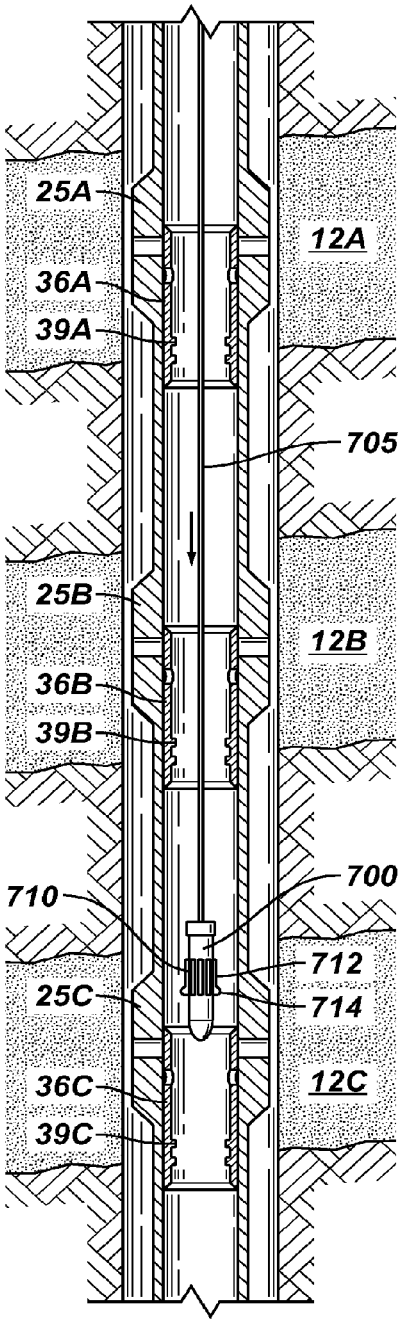
FIGS. 11A-11E illustrate profile views of an embodiment of a plurality of sliding sleeve zonal communication valves being actuated by a latching mechanism suspended by a working string.
Figure 11B:
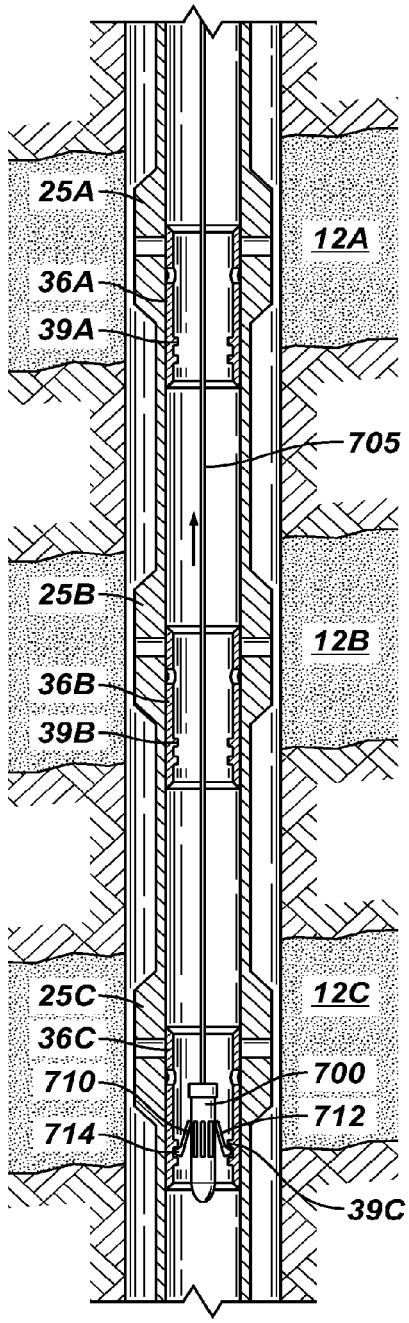
Figure 11C:
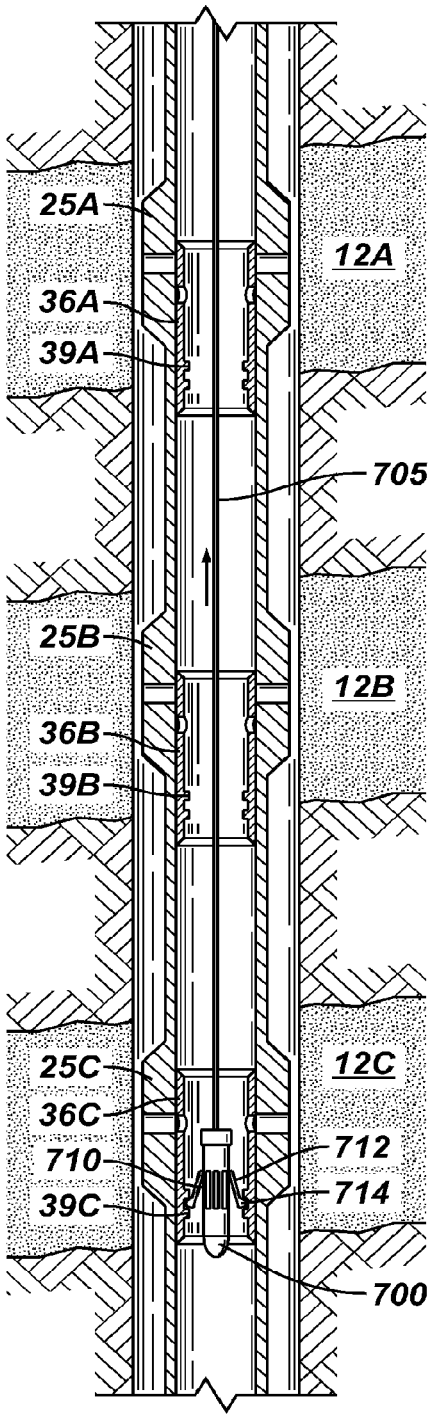
Figure 11D:
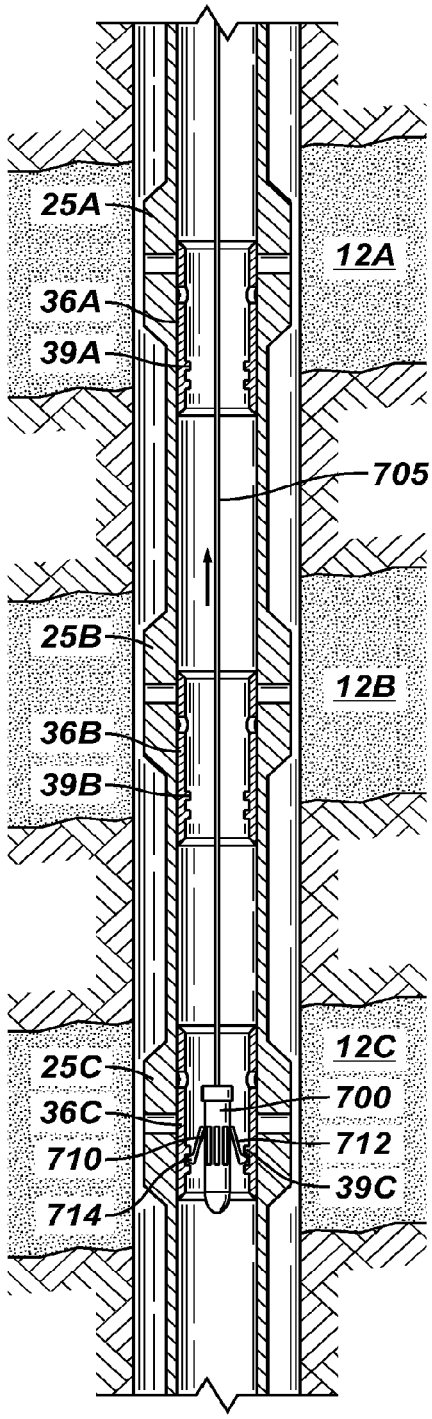
Figure 11E:
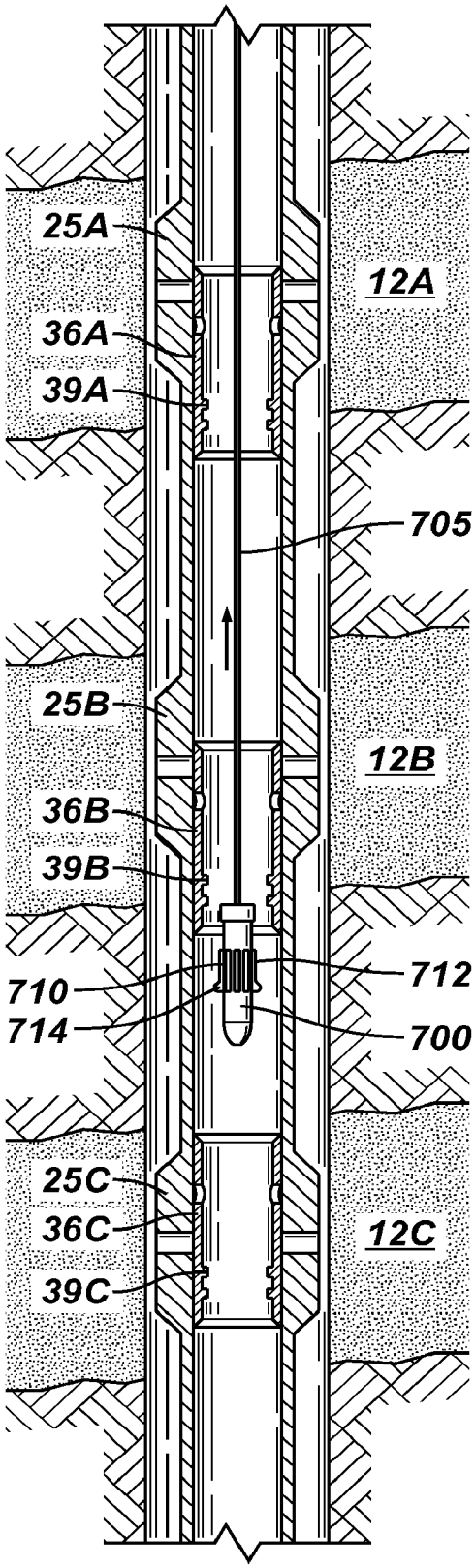

With respect to FIGS. 10A-10C, an embodiment of a procedure for deploying the well completions system of the present invention is provided. In this embodiment, the well completion system is part of a tubular string, which includes one or more sealing mechanisms for providing zonal isolation. In operation, the completion system is run in hole to a target depth where the sealing mechanisms are energized. The sealing mechanisms may be set by either pressurizing the entire casing string or by running a separate setting tool through each zonal isolation device. With each production zone isolated from the next, a service tool may be run in hole to treat each zone.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. .sctn. 112, paragraph 6 for any limitations of any of the claims herein, except for those in which the claim expressly uses the words means for together with an associated function.

What is claimed is:

1. A method usable with a well, comprising:

providing a string comprising a passageway and a plurality of tools;

deploying an untethered object in the passageway such that the object travels downhole via the passageway; and expanding a size of the object as the object travels downhole to cause one of the tools to capture the object, the expanding comprising using the untethered object to wirelessly sense a signal transmitted by the one of the tools and automatically expanding the size of the untethered object before the object reaches the one of the tools in response to sensing the signal.

2. The method of claim 1, wherein the providing comprises providing a plurality of tools comprising valves having seats, each of the seats being sized to catch an object having substantially the same size, and the expanding causes the untethered object to expand to have said same size.

3. The method of claim 2, further comprising:

using the captured untethered object to lodge in one of the seats to plug the string; and subsequently pressurizing the string above the captured untethered object.

4. The method of claim 3, further comprising opening the valve associated with said one of the seats in response to the pressurizing.

5. The method of claim 4, further comprising treating a zone of the well, comprising communicating fluid through the opened valve.

6. The method of claim 1, wherein the using comprises using a receiver of the untethered object to sense a signal emitted by a transmitter disposed downhole near said one of the tools.

7. The method of claim 1, wherein the deploying the untethered object comprises deploying a dart, and the expanding comprises radially expanding an element of the dart to cause the dart to lodge in said one of the tools.

8. The method of claim 1, wherein the deploying comprises pumping the untethered object downhole via the passageway.

9. The method of claim 1, further comprising:

deploying another untethered object in the passageway such that said another untethered object travels downhole via the passageway; and expanding a size of said another untethered object as said another untethered object travels downhole to selectively cause another one of the tools to capture said another untethered object.

10. An apparatus usable with a well, comprising:

a body adapted to travel downhole untethered via a passageway of a string extending into the well, the string comprising a tool and the string comprising at least one transmitter to transmit a wireless signal;

a receiver adapted to travel downhole with the body and receive the signal when in proximity to the tool; and at least one member to radially expand as the body is traveling in response to the receiver sensing the signal to cause the tool to capture the body, wherein the received signal indicates a proximity of the object to the tool.

11. The apparatus of claim 10, wherein the apparatus comprises a dart and the tool comprises a valve comprising a seat in which said at least one member lodges to capture the body.

12. The apparatus of claim 11, wherein said at least one member comprises a fin of the dart.

13. The apparatus of claim 10, wherein the tool is one of a plurality of tools on the string, each tool of the plurality of tools having an opening being sized to catch an object having substantially the same size, the body is adapted to pass through each of the openings when the member is not radially expanded, and the body is adapted to not pass through any of the openings when the member is radially expanded.

14. The apparatus of claim 10, wherein the body is adapted to be pumped downhole through the passageway of the string.

15. The apparatus of claim 10, wherein the at least one transmitter comprises a plurality of transmitters, and the plurality of transmitters being adapted to transmit signals indicative of identifications for the transmitters.

16. The apparatus of claim 15, wherein the identifications are unique with respect to each other.

17. A system comprising:

a string comprising a passageway and a plurality of tools; and an untethered object adapted to:

be deployed in the passageway such that the object travels downhole via the passageway; and controllably expand its size as the object travels downhole before the object reaches one of the tools in response to the object sensing a wireless signal transmitted by the one of the tools to cause one of the tools to capture the object.

18. The system of claim 17, wherein the plurality of tools comprise valves having seats, each of the seats being sized to catch an object having substantially the same size, and the untethered object is adapted to pass through at least one of the seats and controllably expand to said same size to cause capture of the untethered object by one of the valves.

19. The system of claim 17, wherein the untethered object is adapted to constrict flow in the passageway through said one of the valves to generate pressure to transition a state of said one of the valves.

20. The system of claim 17, wherein the string comprises a casing that lines a wellbore of the well.

21. The system of claim 17, wherein the untethered object comprises a dart comprising at least one fin adapted to radially expand in response to the dart approaching said one of the tools.

22. A system comprising:

a string comprising a passageway;

a plurality of valves disposed in the string and each of the valves comprising a seat, wherein each of the seats is sized to catch an object having substantially the same size traveling through the passageway of the string and each of the valves is adapted to control fluid communication between the passageway and a region exterior to the string; and a dart adapted to:

be deployed in the passageway such that the dart travels downhole via the passageway; and controllably expand its size as the dart travels downhole before the dart reaches one of the seats in response to the dart sensing a wireless signal transmitted by a transmitter disposed closer to the one of the seats than to any of the other seats to cause the dart to lodge in the one of the seats.

23. The system of claim 22, further comprising:

another dart adapted to be deployed in the passageway such that said another dart travels downhole via the passageway and controllably expands its size as said another dart travels downhole to selectively cause said another dart to lodge in another one of the seats.

24. The system of claim 22, wherein the string comprises a transmitter disposed in proximity to said one of the seats, the transmitter adapted to transmit a wireless signal; and the dart comprises at least one fin and a receiver adapted to sense the wireless signal to cause the dart to expand said at least one fin to cause the dart to lodge in said one of the seats.

* * * * *